US006695652B1

(12) United States Patent
Reardon, Jr.

(10) Patent No.: US 6,695,652 B1
(45) Date of Patent: Feb. 24, 2004

(54) BATTERY CHARGING CLAMP

(76) Inventor: Joseph P. Reardon, Jr., 13235 County Rd. 345, St. Joseph, MO (US) 64507

( * ) Notice: Subject to any disclaimer, the term of this patent is extended or adjusted under 35 U.S.C. 154(b) by 0 days.

(21) Appl. No.: 10/293,636

(22) Filed: Nov. 13, 2002

(51) Int. Cl.[7] ..... H01R 4/48

(52) U.S. Cl. ..... 439/759; 439/755; 439/822; 439/627

(58) Field of Search ..... 439/759, 755, 439/506, 504, 822, 729, 627

(56) References Cited

U.S. PATENT DOCUMENTS 4,565,414 A * 1/1986 French ..... 439/241

* cited by examiner

*Primary Examiner*—Javaid H. Nasri
(74) *Attorney, Agent, or Firm*—J. David Wharton; Stinson Morrison Hecker LLP

(57) ABSTRACT

A generally U-shaped clamp may be used to connect a charging cable to a terminal of a storage battery to be charged. The clamp includes an elongated main body portion having a longitudinally extending axis and spaced ends. The clamp further includes a first elongated leg member connected to the main body portion at one of its ends. The first leg member extends away from the main body portion in a direction transverse to the axis and has a clamping end segment disposed in laterally spaced relationship to the axis. The clamp also includes second elongated leg member connected to the main body portion at the opposite end thereof from the first leg member. The second leg member also extends away from the main body portion in essentially the same direction as the first leg member and the same has an electrically conductive cable connector carrying end segment disposed in laterally spaced relationship to the clamping end segment of the first leg member. An electrically conductive cable connector is carried by the electrically conductive cable connector carrying end segment and the leg members are configured and arranged so as to embrace a battery therebetween with the electrically conductive cable connector in contact with a terminal on one of the sides of the battery and with the clamping end segment in contact with an opposite side of the battery. The leg members are resiliently biased toward one another to securely place the electrically conductive cable connector into electrical conducting contact with the terminal.

12 Claims, 3 Drawing Sheets

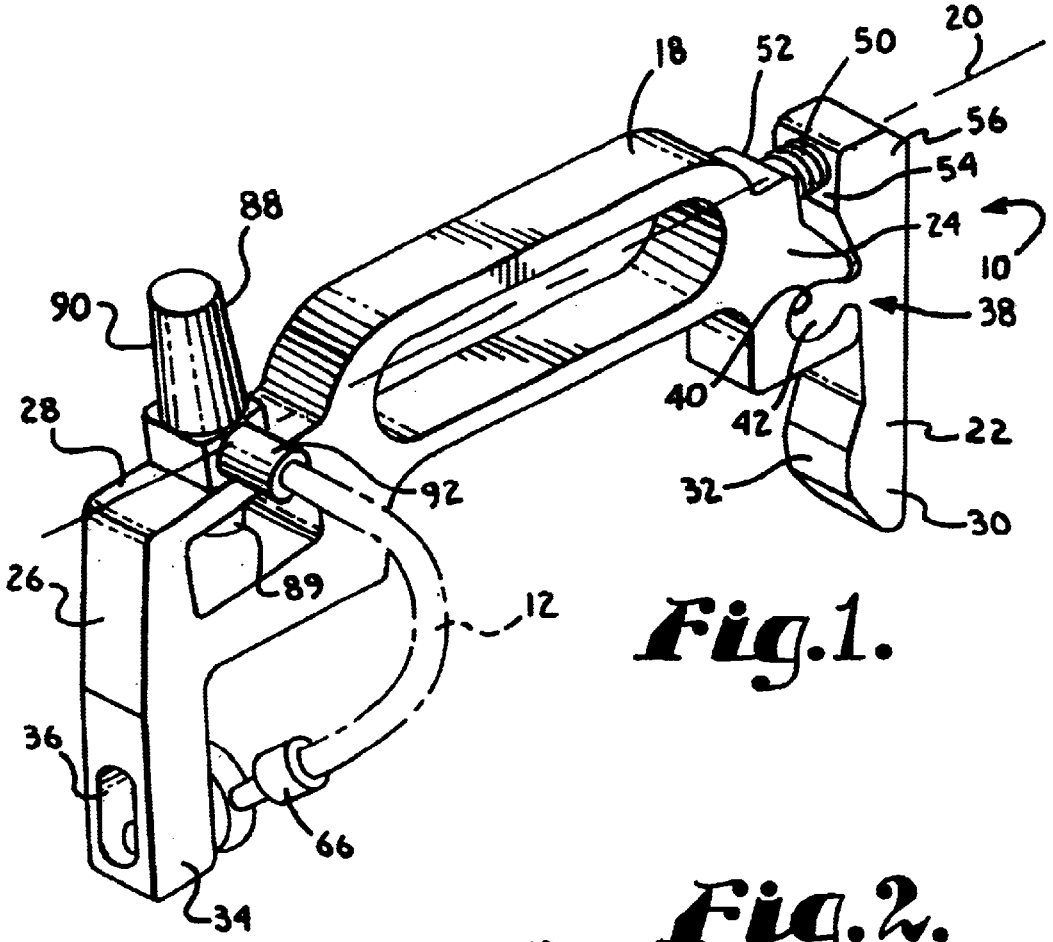
Fig.1.
Fig.2.
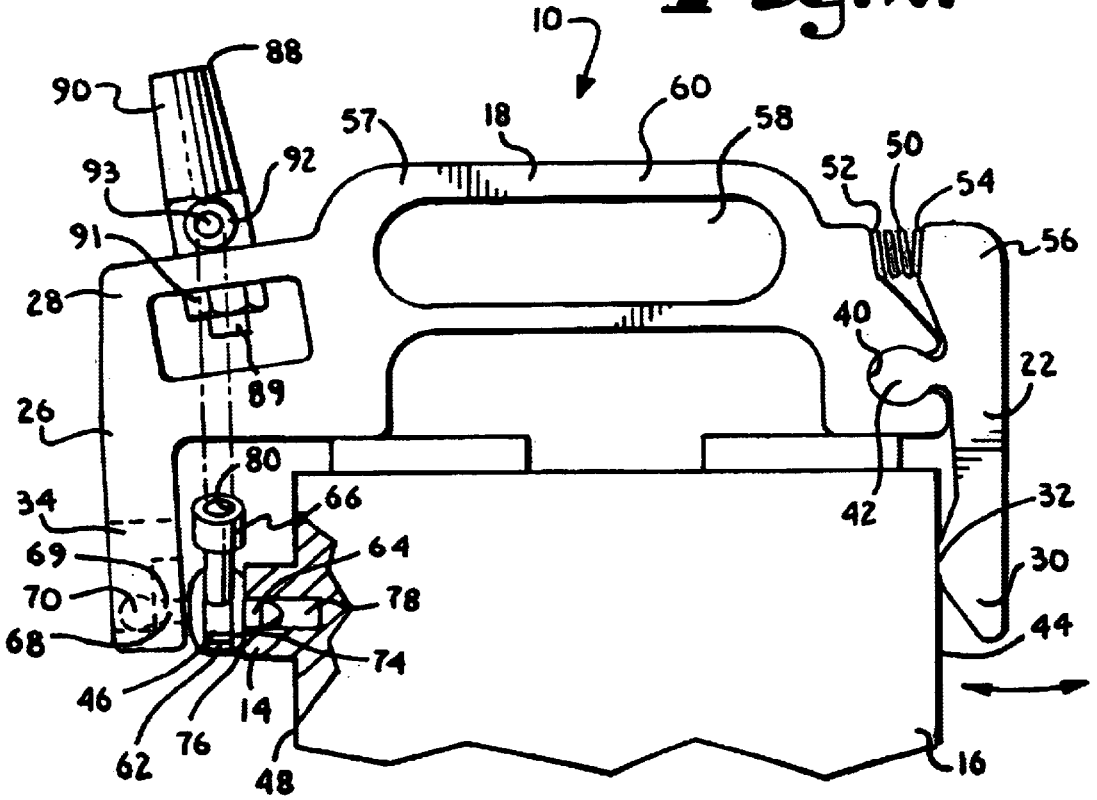

BATTERY CHARGING CLAMP

BACKGROUND OF THE INVENTION

1. Field of the Invention

The present invention relates to the field of storage batteries and in particular to devices for efficiently charging gangs of such batteries prior to first use. More particularly, the invention relates to devices for quickly and efficiently interconnecting gangs of new batteries for purposes of initially charging the batteries prior to first use.

2. The Prior Art Background

Storage batteries are well known in commerce today. Conventionally, however, there is a great deal of non-conformity in the placement of the terminals on storage batteries. That is to say, batteries are often OEM products, and the physical configuration thereof, including in particular the placement of the terminals thereon, may often be a function of the space provided by the designer and manufacturer of automobiles or the like. As a result, the desired placement of the terminals varies considerably among purchasers of the batteries. About the only thing that is consistent between the batteries purchased by different manufacturers is that the same conventionally are generally rectangular in shape.

After storage batteries are manufactured the same must be charged prior to use. Battery manufacturers generally charge many batteries at once by ganging them into groups of 26 or so and connecting them in series to a source of electrical power. The charging operation causes the temperature of the batteries to rise and the elevated temperature slows the charging operation. So it is not unusual for the charging operation to proceed with the gang of batteries located in a cooling tank. In such a tank, the lower casings of the batteries are surrounded by cooling water up to a point just below the terminals.

There are two basic types of batteries those with terminals on the top and those with terminals on the side. In the past it has been the practice during the initial charging operation to screw temporary terminals into each battery to be charged. This has been desirable because the permanent battery terminals are often not large enough to accommodate the connectors of the charger or to handle the relatively large currents employed during charging.

Once the temporary terminals are screwed into the battery casing, heavy duty cables are used to gang the batteries together. The end batteries in the gang are provided with special terminals to facilitate the attachment of the first battery in the series connected gang to the positive connector of the charger and to facilitate the attachment of the last battery in the series connected gang to the negative connector of the charger.

The procedures used in the past are very labor intensive because of the need to manually screw the temporary terminals into the casing, place the charging cables on the terminals, remove the cables after charging, and remove the temporary terminals. Moreover, particularly in the case of batteries with side terminals, the screws and washers tend to last for only a short period of time due to the stresses imposed thereon during the charging operation. This increases the costs of materials used during the charging operation.

Due to the foregoing, the charging operation has in the past been inefficient and labor intensive. Accordingly there has been a long felt need for devices which might make this battery charging operation more efficient and less labor intensive. In particular there has been a need for a simple device for easily and efficiently interconnecting adjacent batteries of a gang of batteries undergoing simultaneous charging.

SUMMARY OF THE INVENTION

The prior art problems discussed above may be alleviated, and perhaps eliminated entirely, by the present invention which broadly provides a generally U-shaped clamp for use in quickly and efficiently connecting an electrically conductive charging cable to a terminal of a conventional storage battery to be charged. In accordance with the concepts and principles of the invention, the clamp desirably includes an elongated main body portion having a longitudinally extending axis and first and second longitudinally spaced ends. The clamp of the invention may also include a first elongated leg member that desirably is connected to the main body portion at the first end thereof. The first leg member may preferably extend away from the main body portion in a direction transverse to the axis, and the same may have a clamping end segment disposed in laterally spaced relationship relative to the axis.

The clamp may also desirably include a second elongated leg member that is connected to the main body portion at the second end thereof. The second leg member also desirably extends away from the main body portion in a direction transverse to the axis, and the same may have an electrically conductive cable connector carrying end segment that is also disposed in laterally spaced relationship relative to the axis. The clamp desirably includes an electrically conductive cable connector that is carried by the electrically conductive cable connector carrying end segment.

In accordance with the concepts and principles of the invention, the leg members ideally are configured and arranged so as to embrace a battery located therebetween with the electrically conductive cable connector in contact with a terminal on one of the sides of the battery and with the clamping end segment in contact with the opposite side of the battery. Ideally the leg members are resiliently biased toward one another so as to securely urge the electrically conductive cable connector into electrically conducting contact with the terminal.

Desirably, in accordance with a preferred embodiment of the invention, the first leg member may be detachably connected to the main body portion. Even more desirably, the first leg member and the main body portion may be detachably connected by a hinge structure that includes an internally rounded cavity and a complementary protruding rounded member positioned in the cavity. Preferably, the hinge structure is configured and arranged so as to permit the clamping end segment to swing relative to the main body portion toward and away from the electrically conductive cable connector. Ideally, in accordance with this aspect of the invention, the cavity may be located on the main body portion and the protruding rounded member may be located on the first leg member. In accordance with a particularly preferred form of the invention, the clamp may include a spring that is operatively engaged between the first leg member and the main body portion in a position to resiliently urge the clamping end segment toward the electrically conductive cable connector.

Desirably, for ease of manual manipulation, the main body portion may include a handle. Preferably, the main body portion and the leg members may be formed from an electrically non-conductive and corrosion resistant material.

Ideally, the material used for forming the clamp components may comprise a polypropylene.

In further accordance with the concepts and principles of the invention, the electrically conductive cable connector of the clamp may desirably include an elongated protrusion that is adapted and configured to make good electrical contact with a terminal fitting of a storage battery. In accordance with this aspect of the invention, it goes almost without saying that the electrically conductive cable connector should be formed from an electrically conductive material. Ideally, the electrically conductive material may comprise lead.

In another preferred embodiment of the invention, the same may be in the form of a device for interconnecting the terminals of adjacent batteries to facilitate simultaneous charging of the batteries of a gang of batteries. In accordance with this aspect of the invention, the device may desirably include a pair of the U-shaped clamps described above. The device of this aspect of the invention may desirably include an elongated, flexible electrically conductive cable that extends between and interconnects the respective electrically conductive cable connectors of the pair of clamps.

BRIEF DESCRIPTION OF THE DRAWINGS

FIG. 1 is a perspective view showing a battery clamp which embodies the concepts and principles of the invention;

FIG. 2 is a side elevational view showing the battery clamp of FIG. 1 in place in a charging disposition on a battery with side terminals;

DETAILED DESCRIPTION OF THE PREFERRED EMBODIMENTS

Figure 3:
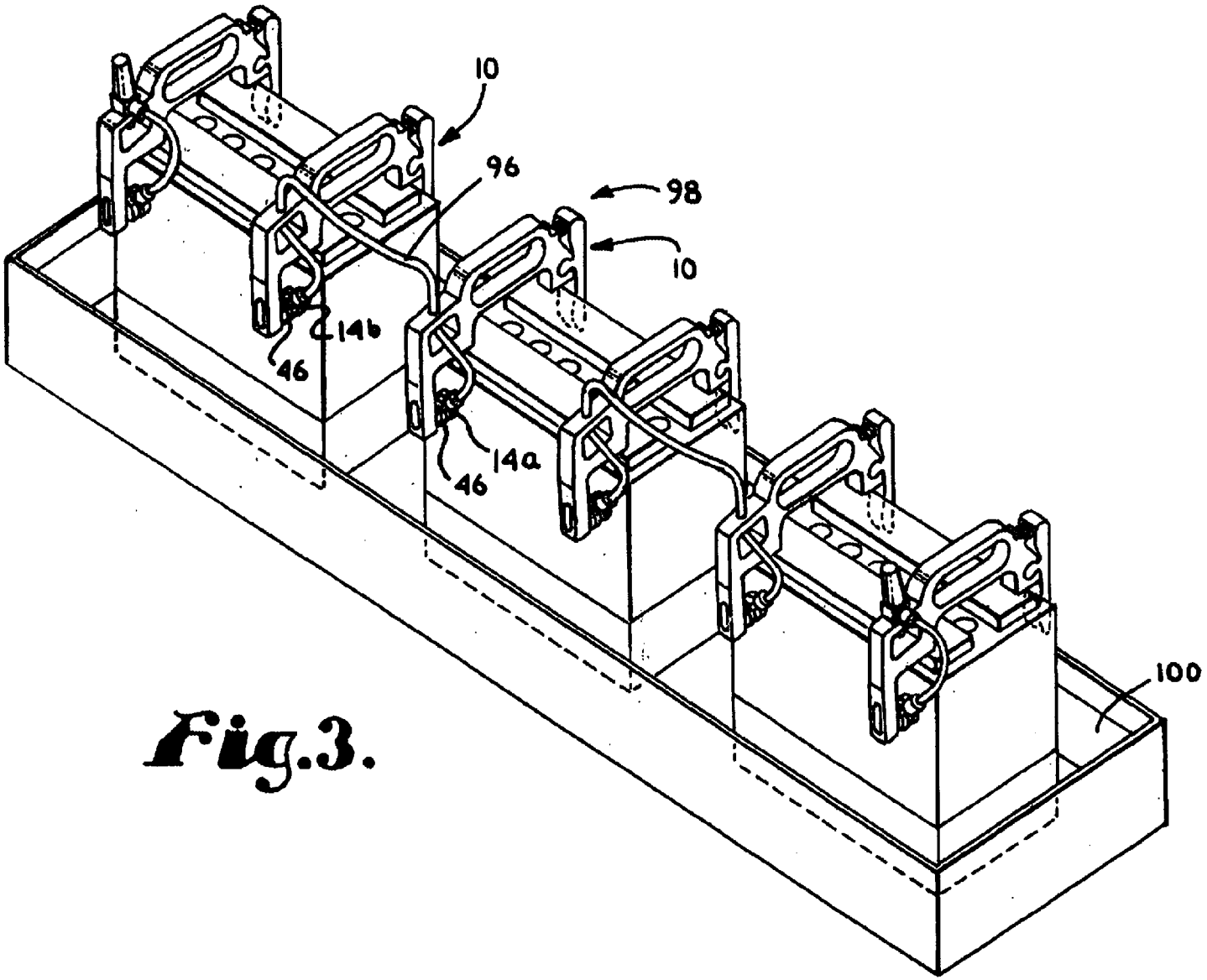
FIG. 3 is a perspective view showing a gang of batteries positioned in a cooling tank and interconnected for charging by the clamps like the clamp of FIG. 1 and which embody the concepts and principles of the invention.

The invention consists of a prearranged clamp which requires far less labor to gang the batteries together, which will require far less labor to remove the charging cables from the batteries after charging and which should reduce the costs of materials incidental to the charging operation.

A battery clamp 10 that embodies the concepts and principles of the invention is illustrated in FIGS. 1 and 2. As is illustrated in FIGS. 1 and 2, battery clamp 10 is adapted and arranged for connecting a charging cable 12 to a terminal fitting 14 of a storage battery 16 to be charged. It is to be noted in this regard that for improved clarity of illustration, cable 12 is not shown in FIG. 2. As shown in FIGS. 1 and 2, battery clamp 10 is generally U-shaped and includes an elongated main body portion 18 having a longitudinally extending axis 20. Clamp 10 also includes a first elongated leg member 22 that is connected to the main body portion 18 at a first end 24 of the latter. Leg member 22 extends laterally away from end 24 in a direction that is transverse to axis 20. In addition, clamp 10 includes a second elongated leg member 26 that is connected to the main body portion 18 at a second end 28 of the latter. As can be seen from FIGS. 1 and 2, ends 24 and 28 are disposed in longitudinally spaced relationship on main body portion 18. Like leg member 22, leg member 26 extends laterally away from end 28 in a direction that is transverse to axis 20.

Leg member 22 includes a clamping end segment 30 that is disposed in laterally spaced relationship relative to axis 20. As shown, end segment 30 may desirably be provided with a portion 32 that protrudes toward leg member 26. Leg member 26 is provided with an electrically conductive cable connector carrying end segment 34 that is also disposed in laterally spaced relationship relative to axis 20. End segment 34 is provided with a connector receiving slot 36.

As shown in FIGS. 1 and 2, leg member 22 may desirably be detachably connected to end 24 of main body portion 18 and clamp 10 may desirably include a hinge structure 38 which permits clamping end segment 30 of leg member 22 to swing relative to main body portion 18 toward and away from cable connector carrying end segment 34 of leg member 26. Hinge structure 38 ideally may include a rounded cavity 40 that is preferably disposed at end 24 of main body portion 18 and a complementarily rounded protrusion 42 disposed on leg member 22. As can be seen viewing FIG. 2, cavity 40 and protrusion 42 are configured to allow rotation of protrusion 42 in cavity 40 to thereby facilitate swinging of leg member 22 about an axis which is generally perpendicular to the plane of the drawing.

With reference to FIG. 2, it can be seen that leg members 22 and 26 are configured and arranged so as to embrace a battery, such as the battery 16, therebetween, with the portion 32 of clamping end segment 30 of leg member 22 in contact with one side 44 of the battery 16 and with a an electrically conductive cable connector 46 that is carried by the connector carrying end segment 34 of leg member 26 in contact with a terminal fitting 14 on the opposite side 48 of the battery. To facilitate this embrace, it is desirable that the leg members 22 and 26 be resiliently biased toward one another so that cable connector 46 is pressed tightly against terminal fitting 14 and placed into secure electrical contact with the latter. To accomplish such resilient biasing of the leg members 22 and 26, the battery clamp 10 may desirably be provided with a spring 50 which is operatively engaged and compressed between a shoulder 52 at end 24 on main body portion 18 and a bearing surface 54 on the end 56 of leg member 22 that is remote from clamping end segment 30. Thus, clamping end segment 30 of leg member 22 is resiliently urged in a direction toward cable connector 46 carried by segment 34 of leg member 26. It should be noted in this regard that the invention does not necessarily depend upon the exact form of the biasing means which could be any sort of spring, or rubber-like insert, or could be provided by the resilient nature of the material from which the clamp is formed.

For ease of placement and manipulation, the clamp 10 may desirably be provided with a handle 57 such as is shown in FIGS. 1 and 2. Thus, the main body portion is formed so as to have an elongated opening 58 therein presenting an elongated bar 60 which may serve as a handle. Ideally, the clamp 10 may be formed by injection molding from a non-electrically conducting, corrosion resistant material, such as, for example, polypropylene.

As can be seen from FIG. 2, the cable connector 46 may desirably have a round central body 62, an elongated central projection 64, an elongated, laterally extending connection fitting 66 and an elongated extension 68 having centrally located shank portion 69 and a spherical knob 70 on the free end thereof remote from the central body 62. Central body 62 may include a curved contact surface 74 that is configured to fit snugly against the outer surface 76 of the battery terminal fitting 14. In addition, since batteries are often produced with a terminal fitting such as the fitting 14 that is adapted to receive an external terminal structure (not shown), and since such fittings generally include a central hole 78 to facilitate attachment of an external terminal structure (not shown) to be added to the battery after the same is charged, the central projection 64 of the connector 46 is adapted and configured for insertion into the central hole 78 of the fitting 14 and to make good electrical contact with the interior of the central hole 78 of the fitting 14. It should also be noted that with the insertion of the projection 64 into the central hole 78, the connection during charging is secure and structurally stabilized.

Desirably the cable connector 46 may formed from an electrically conductive material, such as, for example, lead or the like. An important consideration here is that the connector 46 should desirably be configured so as to avoid hot spots and the Like which can damage the battery casing and/or cause improper charging. As will be appreciated by those skilled in the art, the laterally extending connection fitting 66 may desirably be provided with a central, longitudinally extending opening 80 to facilitate connection to an electrically conductive cable, such as the cable 12 shown in FIG. 1. Thus, a free end of a cable such as the cable 12 may be dipped in molten lead and inserted into the central, longitudinally extending opening 80 and secured therein using molten lead.

Figure 4A:
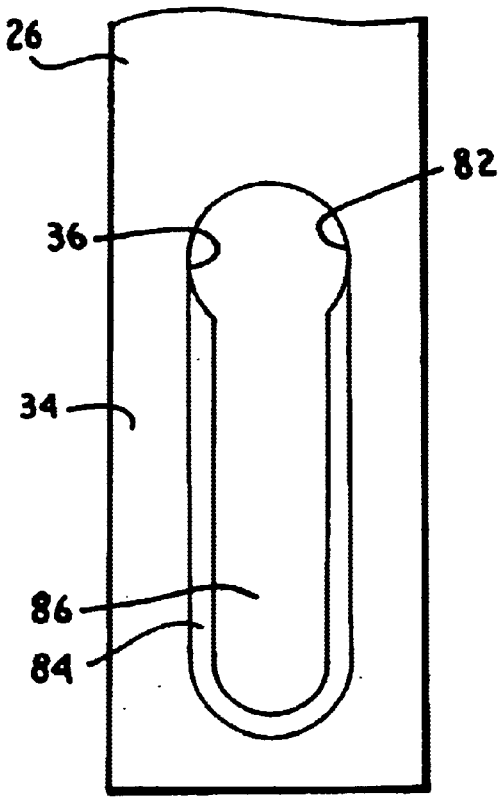
FIG. 4A is an enlarged, fragmentary elevational view of the lower end of an elongated leg member of the clamp of FIG. 1.
Figure 4B:
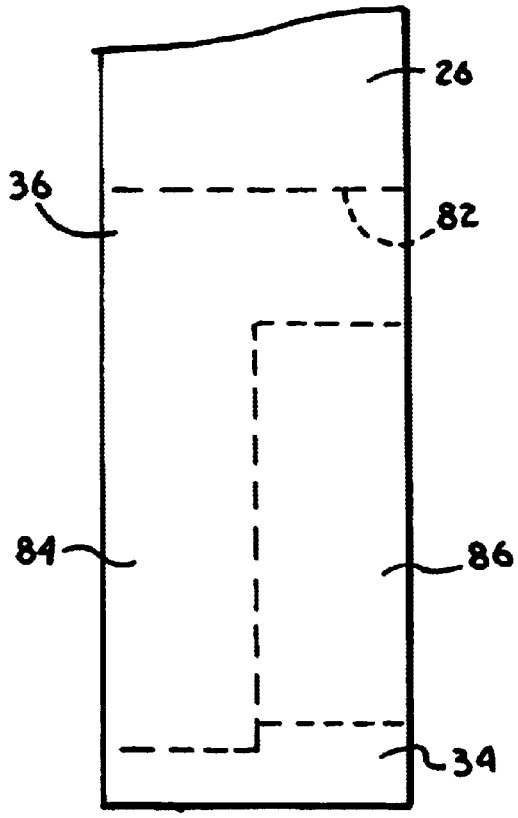
FIG. 4B is a side elevation view of the lower end of the elongated leg member of FIG. 4B.

Desirably, the connector receiving slot. 36 of leg member 26 may have a special shape for securely holding the cable connector 46 in place. A desirable form of this special configuration is illustrated particularly in FIGS. 4A and 4B. Thus, the slot 36 includes a round opening 82 that extends completely through the connector carrying end segment 34 of leg member 26. The slot 36 also includes an elongated, wide external portion 84 and a relatively narrower internal portion 86. The slot 36 is normally oriented such that the round opening 82 is at the top. The round opening is desirably slightly larger in diameter than spherical knob 70 of cable connector 46 and the width w of narrow slot portion 86 is slightly less than the length of shank portion 69. Thus, knob 70 is inserted through opening 82 until it is positioned over the wide external portion 84 and then the entire connector 46 may be lowered so that the shank portion 69 extends through narrow slot portion 86. In this condition, the connector 46 is securely carried in slot 36 of connector carrying end segment 34. This condition is best illustrated in FIGS. 1 and 2.

An important consideration in connection with the foregoing is that the interaction between the slot 36 and the connector 46 should permit vertical movement of the latter relative to the clamp for the purpose of accommodating terminal fittings at different vertical positions on the side of the battery. In addition, the connector 46 should be loosely but securely held by the slot 36 so as to provide a "floating action" to insure proper seating of the connector 46 on the surface 76 of the corresponding terminal fitting 14. Thus, the slots 36 should be configured so as to accommodate not only up and down movement of the connector 46 for positioning purposes, but also side-to-side movement to improve floating action of the connector 46 during the battery charging operation.

FIGS. 1 and 2 illustrate a form of the invention where a single clamp 10 may be used at the end of a gang of batteries being charged to connect the gang with a source of electrical charging power. Thus, the clamp 10 carries an electrically conductive connector device 88 including a frusto-conically shaped terminal portion 90 and a laterally extending connection fitting 92 having a central opening 93. The device 88 desirably includes an extension 89 that extends through a hole provided in the main body portion 18 of the clamp 10. As can be seen in FIG. 2, the extension 89 may be threaded and attached to portion 18 using a threaded nut 91. Cable 12 may then be used to electrically interconnect fitting 92 and fitting 66 of connector 46. For this purpose, one end of cable 12 may be leaded in opening 80 of fitting 66 and the other end of cable 12 may be leaded in opening 93 of fitting 92. A source of electrical charging power (not shown) is connected to terminal portion 90 during charging.

For clarity the charging cable is not shown in FIG. 2. However, it would be appreciated by one skilled in the art that the cable 12 in FIG. 2 would extend between and electrically interconnect the fittings 66 and 92 in the manner shown in FIG. 1.

Another form of the invention is illustrated in FIG. 3 where a cable 96 is used to interconnect two identical clamps 10 so as to present a device 98 for electrically interconnecting adjacent batteries 16. This interconnection is accomplished via the respective fittings 66 of the respective connectors 46 of the clamps 10. In this case, for convenience and structural integrity, the cable 96 may desirably be routed as shown in FIG. 3 where it extends through the respective holes in the ends 28 of the main body portions 18 of the clamps 10 where the device 88 is mounted in FIGS. 1 and 2. Thus, the device 98 includes two clamps 10 and cable 96. One of the clamps 10 of the device 98 is connected to a positive terminal fitting 14*a* and the other clamp 10 of the device 98 is connected to a negative terminal fitting 14*b*. In FIG. 3, for convenience in illustrating the invention, the gang of batteries being charged is shown as including only three batteries hooked up in series arrangement. However, as would be appreciated by the routineers in the related art fields, it is conventional to include as many as 20 or more batteries in a gang being charged. The gang of batteries 16 being charged is also illustrated as being immersed in a bath of cooling water 100 to reduce the temperature of the batteries as they undergo charging and make the charging operation more efficient.

I claim:

1. A generally U-shaped clamp for use in connecting a charging cable to a terminal of a storage battery to be charged having a pair of spaced, opposed sides, said clamp comprising:

an elongated main body portion having a longitudinally extending axis, a first end and a second end, said ends being disposed in longitudinally spaced relationship;

a first elongated leg member connected to said main body portion at said first end thereof, said first leg member extending away from said main body portion in a direction transverse to said axis and having a clamping end segment disposed in laterally spaced relationship to said axis;

a second elongated leg member connected to said main body portion at said second end thereof, said second leg member extending away from said main body portion in a direction transverse to said axis and having an electrically conductive cable connector carrying end segment disposed in laterally spaced relationship to said axis; and an electrically conductive cable connector carried by said electrically conductive cable connector carrying end segment, said leg members being configured and arranged so as to embrace said battery therebetween with said electrically conductive cable connector in contact with a terminal on one of said sides of the battery and with said clamping end segment in contact with another of said sides of the battery, said leg members being resiliently biased toward one another to securely place said electrically conductive cable connector into contact with said terminal.

2. A clamp as set forth in claim 1, wherein said first leg member is detachably connected to said main body portion.

3. A clamp as set forth in claim 2, wherein said first leg member and said main body portion are detachably connected by a hinge structure including a rounded cavity and a complementary protruding rounded member positioned in said cavity, said hinge structure being configured and arranged to permit said clamping end segment to swing relative to said main body toward and away from said electrically conductive cable connector.

4. A clamp as set forth in claim 3, wherein said rounded cavity is located on said main body portion and said protruding rounded member is located on said first leg member,.

5. A clamp as set forth in claim 3, comprising a spring operatively engaged between said first leg member and said main body portion in a position to resiliently urge said clamping end segment toward said electrically conductive cable connector.

6. A clamp as set forth in claim 1, wherein said main body portion includes a handle.

7. A clamp as set forth in claim 1, wherein said main body portion and said leg members are formed from an electrically non-conductive and corrosion resistant material.

8. A clamp as set forth in claim 7, wherein said material comprises polypropylene.

9. A clamp as set forth in claim 1, wherein said electrically conductive cable connector includes an elongated protrusion that is adapted and configured to make good electrical contact with a terminal of a storage battery.

10. A clamp as set forth in claim 1, wherein said electrically conductive cable connector is formed from an electrically conductive material.

11. A clamp as set forth in claim 10, wherein said electrically conductive material comprises lead.

12. A device for interconnecting the terminals of adjacent batteries to facilitate simultaneous charging of the adjacent batteries, said device comprising;

a pair of U-shaped clamps as set forth in claim 1; and an elongated, flexible electrically conductive cable extending between and interconnecting the electrically conductive cable connectors of said clamps.

* * * * *